United States Patent [19]

Stange et al.

[11] Patent Number: 4,765,168

[45] Date of Patent: Aug. 23, 1988

[54] METHOD AND APPARATUS FOR BENDING TUBING

[75] Inventors: Ronald R. Stange, Littleton; Gary E. Demartelaere, Conifer, both of Colo.

[73] Assignee: Tools For Bending, Inc., Denver, Colo.

[21] Appl. No.: 78,465

[22] Filed: Jul. 27, 1987

[51] Int. Cl.[4] ..... B21D 7/04

[52] U.S. Cl. ..... 72/159; 72/149

[58] Field of Search ..... 72/149, 154, 155, 157, 72/158, 159, 369, 320, 321, 322

[56] References Cited

U.S. PATENT DOCUMENTS

| | | | |
|---|---|---|---|
| 2,856,981 | 10/1958 | Hitz | 153/48 |
| 2,882,953 | 4/1959 | Huet | 153/40 |
| 2,955,638 | 10/1960 | Hellwig | 153/32 |
| 2,983,995 | 5/1961 | Gresse | 29/157.6 |
| 2,986,195 | 5/1961 | Landis | 153/40 |
| 3,240,048 | 3/1966 | Callendar | 72/369 |
| 3,546,917 | 12/1970 | Paine | 72/369 |
| 3,584,492 | 6/1971 | Dodge et al. | 72/159 X |
| 4,063,441 | 12/1977 | Eaton | 72/151 |
| 4,078,411 | 3/1978 | Eaton | 72/154 |
| 4,126,030 | 11/1978 | Zollweg | 72/154 |
| 4,130,004 | 12/1978 | Eaton | 72/151 |
| 4,532,787 | 8/1985 | Caporusso | 72/158 |

*Primary Examiner*—E. Michael Combs
*Attorney, Agent, or Firm*—John E. Reilly

[57] ABSTRACT

Tube bending apparatus in which a tube is clamped between a U-shaped bend die and a cooperating pressure die, the pressure die being advanced in a linear direction as the bend die is rotated, a tube groove in each of the dies embracing diametrically opposite sides of the tube. The tube groove on the bend die is of generally U-shaped configuration having a semi-circular bend section and opposite sides extending in tangential directions to define tangential grooves along opposite sides of the bend die, the cross-sectional radii of curvature of the tube groove along the bend section and tangential sections are closely controlled to impart some temporary distortion to the tube which will resist wrinkling or collapse. Similarly, the tube groove on the pressure die has cross-sectional radii of curvature corresponding to those of the bend section of the bend die in order to cooperate with the bend die. In carrying out the method of the present invention, the tube to be bent is clamped between the pressure die and bend die so that it is forced to assume the configuration of the tube grooves on the pressure die and the bend section of the bend die as the bend die is rotated and the pressure die is advanced while maintaining a constant pressure on the tube. Preferably, the pressure die is advanced at variable pressure rates as the tube is bent around the bend section of the bend die so that the pressure die will impart a force tending to minimize the reduction of the outer wall of the tube as the inner wall of the tube is compressed.

21 Claims, 3 Drawing Sheets

METHOD AND APPARATUS FOR BENDING TUBING

This invention relates to a tube bending method and apparatus; and more particularly relates to a novel and improved method and apparatus for bending of tubing and pipe.

BACKGROUND AND FIELD OF THE INVENTION

For some time, it has been customary practice to bend tubing with the use of an internal mandrel so as to minimize wrinkling or crimping of the tube as it is bent; and, while the use of internal mandrels is accepted commercial practice for larger-sized tubing in excess of 3" in diameter, has not been found satisfactory in the bending of smaller tubing.

U.S. Letters Pat. No. 4,130,004 to H. L. Eaton decribes various approaches which have been followed in the bending of tubing without the use of a mandrel, particularly those bending operations which employ compression or draw bending, or a combination of both, in an effort to overcome undesirable wrinkling or buckling of the inner wall or side of the tube as it is being bent around a bend die. Eaton proposes utilization of a generally heart-shaped die and initiates the bending operation by causing a pressure die initially to operate in a draw bending mode followed by a compression bending mode with the tube clamped between the bend die and a clamping die. The pressure die serves to force the tube against the bending die and initially to advance with the tube so as to exert little or no axial restraint in the initial bending then to apply increasing pressure while interrupting the movement of the pressure die so as to exert increasing axial restraint upon the tube in compression bending to complete the bending operation.

Other tube bending operations propose utilization of multiple radius grooves both in the bending and pressure die grooves in order to minimize wrinkling or distortion of the tube through the bending operation and, for example, in U.S. Letters Pat. No. 2,986,195 to A. R. Landis the forming grooves have cross-sectional radii less than one-half the minimum allowable outside diameter of the tube to be bent and which extend around less than 180° of the bending die. In the bending operation, Landis is concerned with avoiding any relative axial shearing movement between the forming dies.

In U.S. Letters Pat. No. 2,955,638 to A. Hellwig, a multiple radius groove is formed on the bending die having an undersized semi-circular groove to impart a squeezing action to the tube in combination with a tangential extension of limited length on the bend die.

Notwithstanding the various approaches taken to bending of tubing and pipe through the use of multiple radius tubing, none to the best of our knowledge has successfully achieved bending of tubing and pipe over different size ranges in such a way as to substantially minimize to the point of eliminating undesirable bulging, collapse or wrinkling of the tube while maintaining a substantially uniform diameter throughout. It has been found that to achieve successful bending of tubing and pipe necessitates the coordination of the relative pressure and speed of advancement between a bending die and pressure die along with a predetermined degree of pressure against the tube and close control over the change in radius between the confronting grooves of the bend die and pressure die to minimize any distortion or wrinkling that is customarily experienced in the methods and apparatus presently in use.

SUMMARY OF THE INVENTION

Accordingly an object of the present invention is to provide for a novel and improved method and apparatus for bending tubing and pipe in a rapid, efficient manner with a minimum of distortion or collapse of the tube.

It is another object of the present invention to provide for a novel and improved method for tubing and pipe which closely coordinates changes in pressure with changes in radii of curvature of confronting tube grooves of a pressure die and bend die between which the tubing is clamped.

It is a further object of the present invention to provide for a novel and improved apparatus for bending tubing which achieves a smooth transition through changes in radii of the tube grooves between which the tubing is clamped and specifically wherein a smooth transition is achieved between a radius equal to that of the tubing to a radius which is less than that of the tubing, the selection of radii being closely coordinated with the size of tubing.

An additional object of the present invention is to provide for a novel and improved method and apparatus for bending tubing in which the rate or speed of pressure die movement is controlled independently of the bend die under positively applied pressure to the trailing end of the pressure die as the bend die is independently rotated.

A still further object of the present invention is to provide for novel and improved apparatus for tube bending which is economical, requires a minimum number of steps and minimum setup time for each different sized tube to be bent.

In accordance with the present invention, there has been devised tube bending apparatus in which a tube to be bent is clamped between a generally U-shaped bend die and a cooperating pressure die, the pressure die being advanced in a linear direction as the bend die is rotated, the bend die and pressure die having confronting faces with a tube groove in each of the faces for embracing diametrically opposite sides of the tube to be bent. In particular, the tube groove on the bend die is characterized by being of generally U-shaped configuration having a generally semicircular bend section and opposite sides extending in tangential directions to define tangential grooves along opposite sides of the bend die, the tangential grooves having a cross-sectional radius of curvature substantially corresponding to that of the tube to be bent. The tube groove along the bend section has a bottom surface portion provided with a cross-sectional radius of curvature less than the cross-sectional radius of the tube to be bent and opposite side surfaces of the bend section groove each having a cross-sectional radius of curvature greater than the radius of the tube to be bent with opposite side surfaces undergoing a smooth, gradual transition into the bottom surface portion. In turn, the tube groove on the pressure die has cross-sectional radii of curvature corresponding to those of the bend section of the bend die, and the radius of curvature of the tangential grooves on the bend die undergoes a gradual transition into the bend section.

In carrying out the method of the present invention, the tube to be bent is clamped between the pressure die and bend die so that it is forced to assume the configuration of the tube grooves on the pressure die and the bend section of the bend die as the bend die is rotated and the pressure die is advanced while maintaining a constant pressure on the tube. Preferably, the pressure die with appropriate hydraulic pressure is advanced at a rate identical to the bend die while the tube is bent around the bend section of the bend die so that pressure die will impart a force tending to prevent the outer wall of the tube from thinning or collapsing as the inner wall of the tube is compressed.

Other objects, advantages and features of the present invention will become more readily appreciated and understood when taken together with the following detailed description in conjunction with the accompanying drawings, in which:

DETAILED DESCRIPTION OF THE PREFERRED EMBODIMENT

Figure 1:
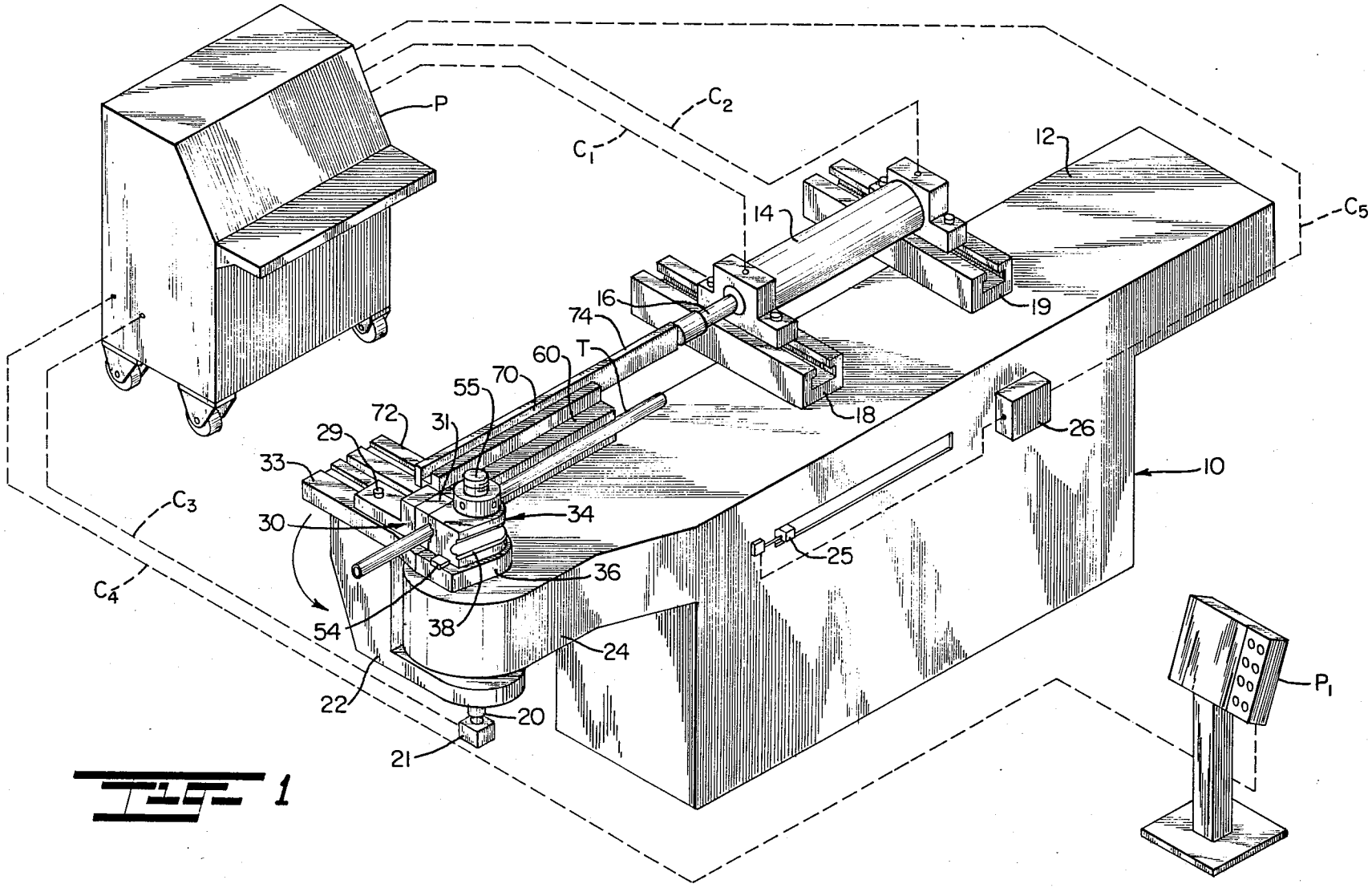
FIG. 1 is a perspective view illustrating a tube bending machine and control panels therefor and the mounting on the machine of a novel form of die assembly in accordance with the present invention.

As a setting for the present invention, there is shown by way of illustrative example in FIG. 1 a conventional form of bending machine 10 having a main upper bed or table surface 12 upon which is mounted a hydraulic cylinder 14 including a plunger 16, the forward and rearward ends of the cylinder 14 mounted in guideways 18 and 19. In accordance with conventional practice, the machine includes a spindle 20 with optical encoder 21 projecting downwardly from attachment to a swing arm 22 in order to control rotational movement of the swing arm 22 around overhanging portion 24 of the machine. Typically, the machine 10 also includes a degree of bend adjustment 25 which is regulated by a control line C5 from panel P into a distance control unit 26 to determine the distance of forward advancement of the plunger 16 in accordance with the degree of band desired. The main control panel P also includes control lines designated at C1 and C2 to the opposite ends of the hydraulic cylinder 14 in order to control the speed and pressure applied by the plunger 16. Control lines C3 and C4 are connected into the spindle 20 and auxiliary control panel P' to regulate the rotational movement of the swing arm 22 and an associated clamping die 30. The auxiliary control panel regulates and coordinates through the control line C4 the speed and pressure of the plunger with respect to the rotational speed of the swing arm 22 in relation to the size and degree of bend of the tubing to be bent, a typical piece of tubing being designated at T in FIG. 1. For the purpose of illustration, one typical form of machine is the MIIC bender sold by Chiro Electric Manufacturing Co., Ltd. of Southfield, Michigan.

It will be noted that the clamping die holder 30 includes a clamping block 31 which are adjustably mounted in a guideway 33 for slidable movement toward and away from the bend die 34. The guideway 33 is affixed to the upper extremity of the swing arm 22 and includes a mounting plate 36 keyed to the upper end of the spindle 20. In a well-known manner, the clamp block 31 has a tube groove 31' of generally semi-circular configuration conforming to the size and configuration of the tube T so as to encircle one-half of the tube. The tube groove 31' of the block has suitable serrations, not shown, and projecting ribs on the block as designated at 38 in FIG. 1 are positioned in diametrically opposed slots on the bend die 34. A locking screw 29 in the clamp die holder 30 is provided to tighten the clamp die and specifically the block 31 against one side of the bend die with the tube T interposed therebetween.

Figure 6:
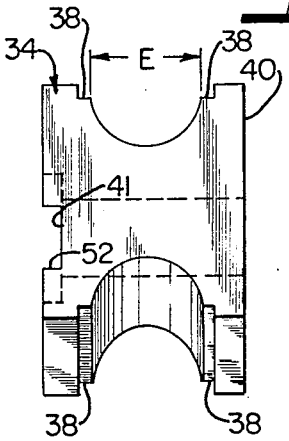
FIG. 6 is an end view taken from the rearward end of a preferred form of bend die.
Figure 7:
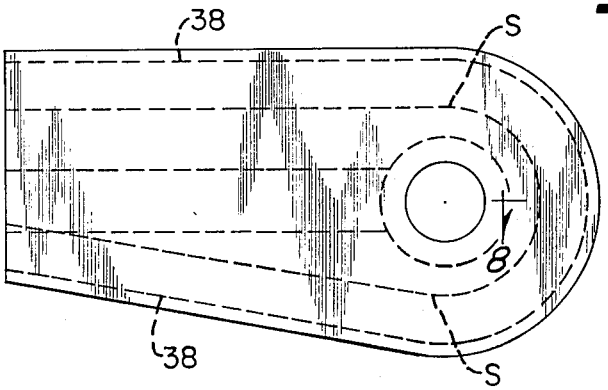
FIG. 7 is a top plan view illustrating the relative distances, in different radii of curvature employed in the formation of the tube groove of a preferred form of bend die.
Figure 8:
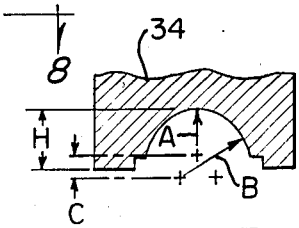
FIG. 8 is a cross-sectional view taken about lines 8—8 of FIG. 7.

Referring in more detail to FIGS. 2, 3, 6 and 7, the preferred form of bend die 34 takes the form of a generally U-shaped block having spaced, parallel top and bottom surfaces 40, 41 with a die cavity or groove formed in and circumscribing outer peripheral wall 43 of the die, except for a squared end portion 44. The groove, as viewed in the plan view of FIG. 3, includes a generally semi-circular portion 46 traversing a rounded end 47 of the die and merging into a tangentially extending, straight groove portion 48 along one side 42 of the die and tangential portion 49 along opposite side 44 of the die to the tangential portion 48. In this relation, the generally semi-circular end portion 46 extends just beyond 180° in merging into the tangential side 49 so that the side portion 49 converges rearwardly toward the side portion 48. It should be noted that the tangential side portions 48 and 49 each extends a distance greater than the circumferential extent of the end groove portion 46, and a central opening 50 extends through the thickness of the die with its axis coinciding with the center of the semicircular end groove portion 46. The central opening 50 is dimensioned to receive the upper end of the spindle 20; and the bottom surface 41 of the die, as shown in FIG. 6, is recessed at 52 to define a keyway aligned with a corresponding keyway in the upper surface of block 36 for the purpose of receiving a key 54. The upper end of the spindle 20 is threaded to receive a lock nut 55 to clamp the bend die 34 securely against the block 36 and to cause the die to be rotated with the block 36 when the swing arm 22 is rotated by the spindle.

As further shown in FIGS. 1 to 5, a pressure die 60 takes the form of an elongated rectangular or oblong block having flat, parallel top and bottom surfaces 61 and 62, opposite squared end portions including a leading end 63 and a trailing end 64, and spaced parallel sides 65 and 66. Opposite sides 65 and 66 are flat surfaces disposed in parallel relation to one another and a die cavity or groove 68 is formed in the side 66 to traverse the entire length of the pressure die 60. As shown in FIG. 1, the pressure die 60 is positioned on the table surface 12 such that its groove 68 is aligned on a common axis with the groove 31' of the clamping die, and the upper surface 61 of the die 60 is aligned flush with the upper surface of the clamping die 30. The pressure die 60 is maintained in axial alignment with the clamping die groove 31' by generally I-shaped backing member 70 which is disposed on a second guideway 72 directly behind the guideway 30 for the clamping die. One portion of the backing member 60 extends rearwardly as at 74 to be engaged by the leading or forward end of the plunger 16 of the hydraulic cylinder 14. Preferably, the pressure die is of a length such that it will remain in constant engagement with the tube T when bent around the entire peripheral wall surface of the die 34.

An important feature of the present invention resides in the radius of curvature given to the bend die 34 and the pressure die 60 so as to avoid wrinkling or collapse of tubing and pipe when bent through different angles. Reference is made to the following Table I illustrating the selection of representative radii of curvature for the bend die and pressure die and the factors employed in selecting the optimum radii.

TABLE I

| Factors | .422 | .6667 | .1787 | .9916 | .5267 | .455 |
|---|---|---|---|---|---|---|
| Tube OD | A | B | C | E | H | K |
| 2.000 | .844 | 1.333 | .358 | 1.983 | 1.053 | .910 |
| 1.500 | .633 | 1.000 | .269 | 1.475 | .790 | .683 |
| 1.000 | .422 | .667 | .179 | .992 | .527 | .455 |
| .500 | .211 | .333 | .089 | .496 | .263 | .228 |
| .250 | .106 | .167 | .044 | .248 | .132 | .114 |

As noted from FIGS. 4 to 7, for a tube having an outside diameter of 2", the diameter of the tube groove 46 at E along the end of the bend die across the entrance to the groove is 1.983", or just less than the diameter of the tube. This will cause a slight reduction in the diameter of the tube in a vertical direction, or direction normal to the bend. The radius of curvature A at the bottom of the groove along the bend area is 0.844" or less than one-half the diameter of the tube while the radius of curvature B along opposite sides of the groove is greater than one-half of the diameter of the tube. It is important that the center of the radius of curvature B for each side of the groove be located at center points B' which are disposed eccentrically with respect to the center A' for the bottom of the groove in order to establish a smooth transition between the radius of curvature A from the bottom into the side radii B. Moreover, the side radii B should continue circumferentially beyond the center A'. Thus, the depth of groove H is established as being 0.053" greater than the radius or one-half the outside diameter of the tube, and the location of the eccentric centers B' established at distance C from the center A. The transition or blend between radii A and B is completed by grinding to a uniform gradation in curvature between the two radii A and B so as to eliminate any irregularity in the groove.

The multi-radius configuration A and B as described continues throughout the bend area 46 and undergoes a transition into semi-circular grooves along the tangential sections 48 and 49 of the bend die. Preferably, this transition is accomplished by causing the bottom of the groove A to slope upwardly at a gradual angle on the order of 5° into the bottom of the semi-circular or single radius groove along the tangential sections 48 and 49. This sloping will occur at points beginning at each end of the bend area and continue through a limited distance depending on the diameter of the tube to be bent.

Similarly, the pressure die 60 is formed with a groove 68 which is a multi-radius groove having the same dimensions or radii A, B as the bend area 46 of the bend die. However, the depth of the groove is just less than one-half the outside diameter or 0.910", as designated at K, and the opening size at the entrance is approximately 0.050" less than the opening size E of the bend die, as a result of the groove being shallower.

The leading edge 63 of the pressure die which is aligned opposite to one side of the bend area 46 of the bend die is given a semi-circular configuration corresponding to that of the tangent sections 48 and 49 but slopes or merges from that semi-circular groove into the multi-radius groove which traverses the remaining length of the pressure die. As earlier described with reference to the bend die, the transition or slope S' from the semi-circular groove into the multi-radius groove cross-section is preferably on the order of 5°. Both in the case of the bend die and the pressure die, the transition or slope between grooves in each die can be accomplished by grinding along a gradual angle as described so as to avoid corners or irregularities which could cause scarring of the outer surface of the tube, particularly in softer metal, such as, copper.

Figure 2:
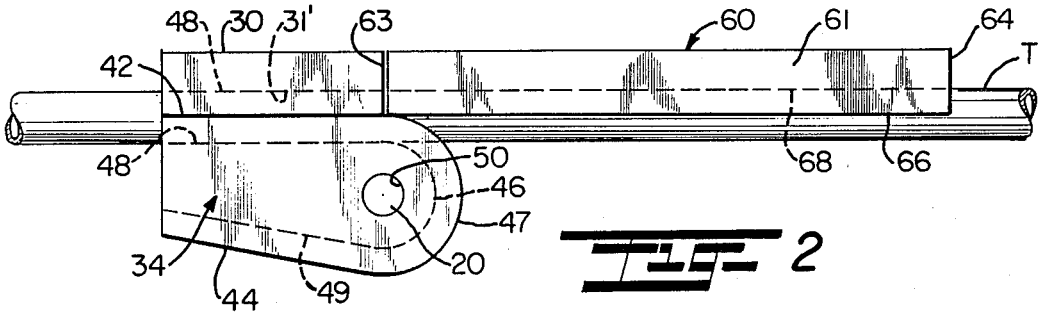
FIG. 2 is a top plan view illustrating the interrelationship between bend die, pressure die and clamping die at the initiation of a bend in accordance with the present invention.
Figure 3:
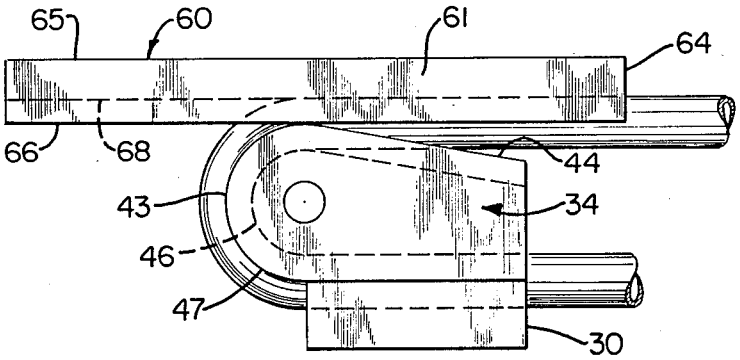
FIG. 3 is a top plan view illustrating the interrelationship between bend die, pressure die and clamping die at the completion of a bend.
Figure 4:
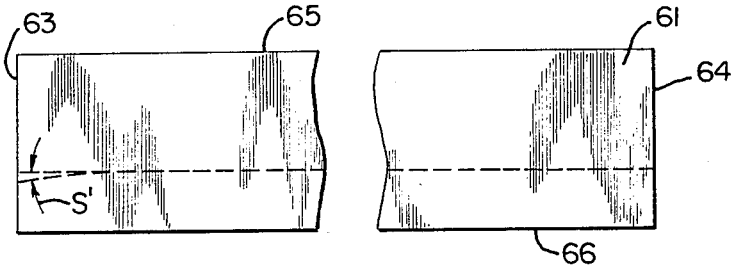
FIG. 4 is a side view in elevation of a preferred form of pressure die.
Figure 5:
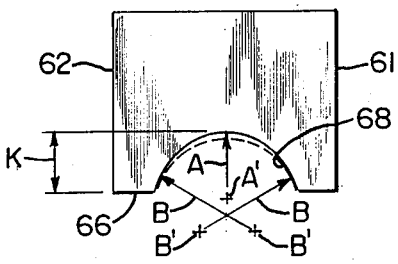
FIG. 5 is an end view of the preferred form of pressure die shown in FIG. 4.
Figure 9:
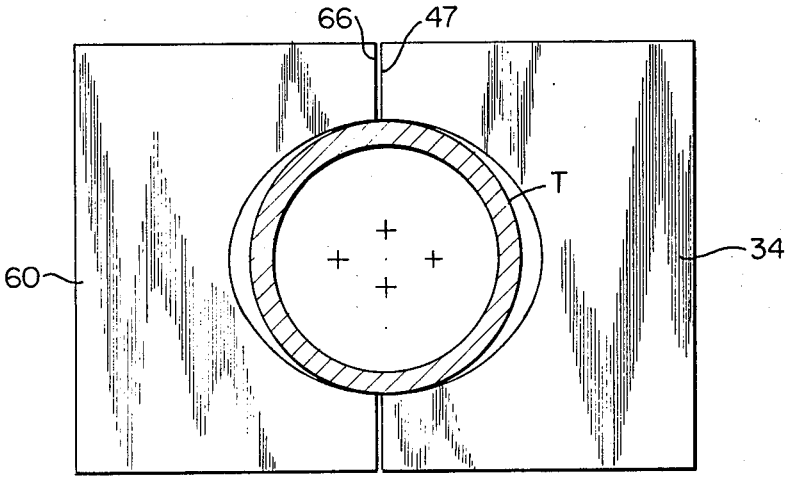
FIG. 9 is a cross-sectional view illustrating the radii of curvature of the bend die and pressure die with respect to a tube to be bent.
Figure 10:
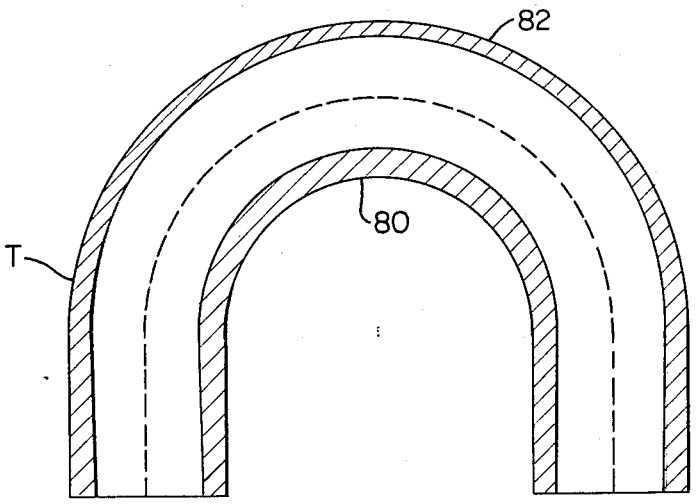
FIG. 10 is a horizontal section view taken through a tube at the completion of a bending operation and illustrating the variation in wall thickness of the tube.

In practice, and as shown in FIGS. 1 and 2, the tube T has one end clamped between the bend die 34 and clamping die 30 which is aligned with the semi-circular groove on the bend die leading into the tangent section 48. The pressure die 60 is disposed in abutting relation to the end of the clamping die 30 such that the leading end 63 has its semi-circular groove section as designated at S' aligned with the end of the tangential section 48 at its transition into the bend area 46. As described, the depth of the pressure die groove 66 is shallower than that of the bend die groove 46 and 48 so as to move into firm, clamping engagement with the tubing with a slight clearance or gap left between the confronting surfaces of the pressure die and the bend die. The bend die 34 is rotated by the swing arm 22 at a constant rate of speed typically on the order of 5 to 6 rpm. Simultaneously, the pressure die is advanced by the plunger 16 in a linear direction so as to maintain bending pressure on the tube T as the bend die is rotated, for example, from the position illustrated in FIG. 2 to that illustrated in FIG. 3. Initially, a reduced hydraulic force is applied to the pressure die through a limited range of movement on the order of 5% to 10% of the total range or distance of movement through which the tubing is to be advanced. The hydraulic force of advancement on the pressure die is then increased to minimize the stretching or elongation to the outer wall of the tube engaged by the pressure die 60 as the tube is being bent along the bend area 46 of the bend die 34. As the pressure die 60 approaches the end of its advancement, the hyudraulic force is reduced to that of the initial 5%-to-10%. Throughout the bending cycle, clamping pressure exerted by the pressure die and bend die is such as to squeeze the tube T or reduce its effective diameter between upper and lower entrance edges of the grooves 46 and 66; however, the increased depth or bottom areas H and K of the grooves will accommodate the increase in effective diameter of the tube in a radial direction extending from the bend die axis of rotation at 20. This is best illustrated from FIGS. 9 and 10 wherein FIG. 9 shows the slight squeezing or inward bending of the tube T between the entrances to the grooves, or in a vertical direction as viewed in FIG. 9. To compensate for this inward squeezing, the sides of the tube are free to bow or expand outwardly into the bottoms of the grooves. As a consequence, and as shown in FIG. 10, the resultant tube upon completion of a 180° bend will accumulate slightly increased wall thickness along the inner surface of the bend as indicated at 80, but the outer wall 82 will undergo some stretching or elongation and reduction in wall thickness. Of course, the hydraulic force of advancement of the pressure die relative to the bend die will reduce the stretching or elongation of the outer wall; and the slight expansion of the tube as described in a horizontal direction, as viewed in FIG. 9, will resist any tendency of the tube to buckle or wrinkle.

Virtually all metal tubing exhibits sufficient resiliency that, upon completion of the bending operation, the tube will return to its original diameter. Moreover, there will be a tendency for the tubing to spring outwardly to a position less than the degree of bend. For this reason, it is important to form at least one side of the bend die, such as, along the tangential section 49 at an angle greater than 180° to that of the section 48 so that the tubing will be bent through an angle greater than 180° sufficient to compensate for its tendency to spring outwardly to a 180° bend angle, as shown in FIG. 10.

90° bends may be performed with the bend die and pressure die of the present invention simply by controlling the distance of advancement of the dies through 90°, or slightly greater than 90°. Again, the rotary draw bending operation and hydraulic force of advancement of the pressure die 60 with respect to the bend die 34 will cause some build-up or increase in thickness of the tube T1 as designated at 84 and not as much reduction in thickness along the outer wall 86. Bends may be formed at different desired angles by suitable regulation of the bend adjustment control 26 as described.

It will therefore be evident that the bend die 34 and pressure die 60 undergo a change in radius in a smooth transition from a semicircular groove to a multi-radius groove throughout the bending area, initially advancing the pressure die at the same rate as the bend die along the straight section of the bend die, then increasing the hydraulic force of advancement along the bend area followed by reducing this force at the completion of the bend. This is true whether carrying out 180° bends or less than 180° bends.

The factors as indicated in Table I are arrived at largely by trial and error, once a determination is made that a tube is of a diameter and wall thickness which is susceptibe to bending without an internal mandrel in the manner described. This determination may be best made by calculating the wall factor of the tube (WF) as follows:

$$\frac{\text{outside diameter of tube } (OD)}{\text{tube wall thickness } (WT)} = \text{wall factor } (WF)$$

The bend radius ($D/B$) is determinated as follows:

$$\frac{\text{center line radius of bend section } (CL)}{OD} = D/B$$

Finally:

-continued $$\frac{WF}{D/B} = \text{Empty Bending } (E/B) \text{ Factor}$$

If the (E/B) factor is less than 10, the tube is one that would qualify for bending in the manner described; if (E/B) is greater than 13, generally speaking it may not qualify for tube bending in accordance with the invention. It should be emphasized that the foregoing is a rule of thumb determination arrived at only to avoid preliminary trial and error in determining whether a given size and wall thickness of tube can be bent as described. This determination may be further influenced by other factors, such as, composition of material and extreme differences in wall thickness.

It is therefore to be understood that various modifications and changes may be made in the preferred method and apparatus of the present invention as hereinbefore described without departing from the spirit and scope of the invention as defined by the appended claims.

We claim:

1. In a tube bending machine in which the tube to be bent is clamped between a generally U-shaped bend die and a cooperating pressure die, the pressure die being advanced in a linear direction as said bend die is rotated, said bend die and pressure die having confronting faces with a tube groove in each of said faces for embracing diametrically opposed sides of said tube to be bent, the improvement comprising:

said tube groove on said bend die being generally U-shaped having a bend section of generally semicircular configuration and opposite sides extending in tangential directions substantially parallel to one another to define tangential grooves along said opposite sides of said bend die, said tangential grooves having a cross-sectional radius of curvature substantially corresponding to that of said tube to be bent, said tube groove along said bend section having a bottom surface portion with a cross-sectional radius of curvature less than one-half of the outside diameter of said tube to be bent and opposite side surfaces of said bend section each having a cross-sectional radius of curvature greater than one-half of the outside diameter of said tube to be bent, and said opposite side surfaces undergoing a smooth gradual transition into said bottom surface portion.

2. In a tube bending machine according to claim 1, including means for clamping a leading end of said tube to be bent to said bend die in leading relation to said pressure die.

3. In a tube bending machine according to claim 1, said tube groove on said pressure die having cross-sectional radii of curvature corresponding to that of said bend section of said bend die.

4. In a tube bending machine according to claim 1, the radius of curvature of said tangential grooves on said bend die undergoing a gradual transition into said bend section, and the radius of curvature along the bottom surface of said bend section being on the order of 85% of the radius of curvature of said tube to be bent.

5. In a tube bending machine according to claim 1, said bend section extending for just greater than 180°, and said tangential grooves of said bend die converging away from said bend section for a distance substantially equal to the circumferential length of said bend section.

6. In a tube bending machine according to claim 1, including means for rotating said bend die at a constant rate of speed, and means at a variable rate of force to said pressure die.

7. In a tube bending machine according to claim 6, said means for advancing said pressure die being operative to advance said pressure die initially at a rate of speed and force corresponding to the speed of said bend die rotation and to increase force of advancement to said pressure die.

8. In a tube bending machine acccording to claim 1, said pressure die having a generally semi-circular groove at one end thereof merging into a multiple radius of curvature groove throughout its greater length, said multiple radius curvature corresponding to that of said bend section.

9. In a tube bending machine according to claim 8, said pressure die having a tube groove which is shallower than said tube groove along said bend section of said bend die.

10. In a tube bending machine according to claim 1, said bend die having said confronting face extending along one of said tangential grooves of said bend die.

11. In a tube bending apparatus for bending thin-walled tubing of less than 3" in diameter wherein the tube to be bent is clamped between a generally U-shaped bend die and a cooperating pressure die, the pressure die being advanced in a linear direction as said bend die is rotated, said bend die and pressure die each having confronting faces with a tube groove in each of said faces for embracing diametrically opposed sides of said tube to be bent, the improvement comprising:

said tube groove on said bend die being generally U-shaped and having a bend section of generally semi-circular configuration and opposite sides of said bend die extending in tangential directions from opposite ends of said bend section substantially parallel to one another to define tangential grooves along said opposite sides of said bend die, said tangential grooves having a cross-sectional radius of curvature substantially corresponding to that of said tube to be bent, said tube groove along said bend section having a bottom surface portion with a cross-sectional radius of curvature less than one-half of the outside diameter of said tube to be bent and opposite side surfaces of said bend section each having a cross-sectional radius of curvature greater than one-half of the outside diameter of said tube to be bent; and said tube groove on said pressure die having cross-sectional radii of curvature corresponding to that of said bend section of said bend die along its greater length, a generally semi-circular groove at one end of said pressure die, and said tube groove on said pressure die being shallower than said tube groove along said bend section of said bend die.

12. In a tube bending machine according to claim 11, said tangential grooves undergoing a gradual transition into said bend section, said bend section extending for just greater than 180°, and said tangential grooves converging away from said bend section for a distance substantially equal to the circumferential length of said bend section.

13. In a tube bending machine according to claim 11, including means for rotating said bend die at a constant rate of speed, and means for advancing said pressure die at a variable force of advancement.

14. In a tube bending maching according to claim 13, said means for advancing said pressure die being opperative to advance said pressure die initially at a rate of speed corresponding to the speed of said bend die rotation and to increase advancement force applied to said pressure die as said tube is bent around said bend section.

15. A method of bending a tube into a predetermined curvature comprising the steps of:

positioning the tube against a straight section of a first semi-circular groove in a bend die wherein the first groove has a radius of curvature corresponding to that of the tube;

bending said tube around a curved section of a second groove in said bend die which forms a continuation of the first groove, said second groove having a bottom surface portion with a cross-sectional radius of curvature less than one-half of the outside diameter of the tube to be bent and opposite side surfaces in said second groove having a cross-sectional radius of curvature greater than one-half of the outside diameter of the tube to be bent; and forcing said tube successively into said first and second grooves of said bend die whereby said tube assumes the configuration of said second groove as it is bent around said curved section of said bend die.

16. The method according to claim 15, further characterized by the initial step of clamping said tube against the straight section of said bend die, and rotating said bend die while maintaining said tube in clamped relation to said bend die.

17. The method according to claim 16, in which the step of positioning the tube in the straight section of said first groove of said bend die is characterized by placing a pressure member against said tube in diametrically opposed relation to said first groove, said pressure member having a straight groove therein provided with cross-sectional radii of curvature corresponding to that of said second groove of said bend die.

18. The method according to claim 17, including the step of advancing said pressure member in a tangential direction with respect to said curved section of said bend die as said bend die is rotated.

19. The method according to claim 18, characterized by advancing said pressure member at a rate at least as fast as the rate of rotation of said bend die.

20. The method according to claim 19, wherein said bend die is provided with a pair of straight sections at opposite ends of said curved section, each straight section provided with a semi-circular groove having a radius of curvature corresponding to that of said tube, and bending said tube around said straight sections and said curved section until a bend of the desired degree of bend is formed.

21. The method according to claim 20, including the steps of advancing said pressure member initially at a rate of speed and advancement force corresponding to the rate of rotation of said bend die, increasing the advancement force of said pressure member with respect to said bend die as said tube is bent around said curved section of said bend die, and reducing the advancement force of said pressure member to correspond to the rate of rotation of said bend die as said tube is brought into contact with the other of said straight sections of said bend die.

* * * * *